US006467340B1

(12) United States Patent
Gallagher et al.

(10) Patent No.: US 6,467,340 B1
(45) Date of Patent: Oct. 22, 2002

(54) ASPHALTENES MONITORING AND CONTROL SYSTEM

(75) Inventors: Christopher Gallagher, Katy; C. Mitch Means, Richmond, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/690,164

(22) Filed: Oct. 17, 2000

Related U.S. Application Data

(60) Provisional application No. 60/160,472, filed on Oct. 21, 1999.

(51) Int. Cl.[7] ..... G01N 15/07; G01N 15/06

(52) U.S. Cl. ..... 73/152.18; 73/152.24; 73/61.41; 73/61.43; 73/61.59; 166/250.05; 166/264; 175/58; 175/50

(58) Field of Search ..... 73/152.18, 152.24, 73/152.23, 152.28, 152.42, 61.41–61.43, 61.59, 61.73; 166/270.1, 250.05, 275, 264; 175/58, 60, 50

(56) References Cited

U.S. PATENT DOCUMENTS

| | | | | | |
|---|---|---|---|---|---|
| 2,283,429 | A | * | 5/1942 | Ennis | 73/51 |
| 2,696,112 | A | * | 12/1954 | Griffith | 73/155 |
| 3,248,938 | A | * | 5/1966 | Hill et al. | 73/155 |
| 3,839,914 | A | * | 10/1974 | Modisette et al. | 73/438 |
| 4,131,815 | A | * | 12/1978 | Boatright | 310/323 |
| 4,240,287 | A | * | 12/1980 | Mast et al. | 73/61 R |
| 4,535,851 | A | * | 8/1985 | Kirkpatrick et al. | 175/38 |
| 4,817,711 | A | * | 4/1989 | Jeambey | 166/248 |
| 4,843,247 | A | | 6/1989 | Yamazoe et al. | 250/573 |
| 4,916,946 | A | * | 4/1990 | Cameron | 73/155 |
| 5,008,085 | A | * | 4/1991 | Bain | 422/109 |
| 5,202,016 | A | * | 4/1993 | Church et al. | 210/85 |
| 5,681,986 | A | * | 10/1997 | Merk et al. | 73/61.75 |
| 5,754,722 | A | | 5/1998 | Melling | 385/115 |

FOREIGN PATENT DOCUMENTS

| | | |
|---|---|---|
| WO | WO 98/50680 | 11/1998 |
| WO | WO 98/57030 | 12/1998 |

* cited by examiner

*Primary Examiner*—Hezron Williams
*Assistant Examiner*—David J. Wiggins
(74) *Attorney, Agent, or Firm*—Madan, Mossman & Sriram, P.C.

(57) ABSTRACT

The present invention provides a system that monitors and controls the precipitation of asphaltenes in a formation fluid recovered from a subsurface formation or reservoir by using a sensor to make a direct real-time on-site measurement of the relative concentration asphaltenes from at least one location at a wellsite or in a pipeline. In a system including a fiber optic attenuated total reflectance probe for sensing asphaltenes and using a processor to compare sequential measurements, the system of the present invention can trigger the addition of additives in response to a change in asphaltene concentration in the formation fluid, preventing precipitation.

15 Claims, 5 Drawing Sheets

ASPHALTENES MONITORING AND CONTROL SYSTEM

CROSS REFERENCE TO RELATED APPLICATION

This application claims priority from provisional application No. 60/160,472 filed Oct. 21, 1999.

BACKGROUND OF THE INVENTION

1. Field of the Invention

This invention relates to system for use in oilfield and pipeline operations to monitor and control asphaltenes precipitation in formation fluids. This invention particularly relates to a system and the associated method for determining whether asphaltenes precipitating out of solution in a wellbore, pipeline and the like are being deposited inside the wellbore.

2. Background of the Art

Many formation fluids such as petroleum fluids contain a large number of components with a very complex composition. For the purposes of the present invention, a formation fluid is the product from an oil well from the time it is produced until it is refined. Some of the components present in a formation fluid, for example wax and asphaltenes, are normally solids under ambient conditions, particularly at ambient temperatures and pressures. Waxes comprise predominantly high molecular weight paraffinic hydrocarbons, i.e. alkanes. Asphaltenes are typically dark brown to black-colored amorphous solids with complex structures and relatively high molecular weight. In addition to carbon and hydrogen in the composition, asphaltenes also can contain nitrogen, oxygen and sulfur species. Typical asphaltenes are known to have some solubilities in the formation fluid itself or in certain solvents like carbon disulfide, but are insoluble in solvents like light naphthas.

When the formation fluid from a subsurface formation comes into contact with a pipe, a valve or other production equipment of a wellbore or when there is a decrease in temperature, pressure, or change of other conditions, asphaltenes may precipitate or separate out of a well stream or the formation fluid while flowing into and through the wellbore to the wellhead. While any asphaltene separation or precipitation is undesirable in and by itself, it is much worse to allow the asphaltene precipitants to accumulate by sticking to the equipment in the wellbore. Any asphaltene precipitants sticking to the wellbore surfaces may narrow pipes; and clog wellbore perforations, various flow valves, and other wellsite and downhole equipment. This may result in wellsite equipment failures. It may also slow down, reduce or even totally prevent the flow of formation fluid into the wellbore and/or out of the wellhead.

Similarly, undetected precipitations and accumulations of asphaltenes in a pipeline for transferring crude oil could result in loss of oil flow and/or equipment failure. Crude oil storage facilities could have maintenance or capacity problems if asphaltene precipitations remain undetected for an extended period of time.

As a result of these potential problems, during oil production in production wells, the drilling of new wells, or work overs of existing wells, many chemicals, also referred to herein as "additives", including solvents, are often injected from a surface source into the wells to treat the formation fluids flowing through such wells to prevent or control the precipitation of asphaltenes. In addition to controlling asphaltene precipitations, additives are also injected into producing wells to, among other things, enhance production through the wellbore, lubricate downhole equipment, or to control corrosion, scale, paraffin, emulsion and hydrates.

All these chemicals or additives are usually injected through a conduit or tubing that is run from the surface to a known depth. Also, chemicals are introduced in connection with electrical submersible pumps, as shown for example in U.S. Pat. No. 4,582,131 assigned to the assignee hereof and incorporated herein by reference, or through an auxiliary line associated with a cable used with the electrical submersible pump, such as shown in U.S. Pat. No. 5,528,824 assigned to the assignee hereof and incorporated herein by reference.

While much more commonly used to minimize paraffin deposition problems, it has been disclosed that asphaltene precipitation can be, if not controlled, at least mitigated by providing heat to equipment to raise the temperature of crude oil, for example, to a temperature higher than its cloud point, also referred to as the deposition temperature, to prevent or at least minimize asphaltene precipitations. A circulating heat transfer fluid or medium is usually used as the heating means to effect the desired temperature changes.

Several other ways of addressing the asphaltene precipitation problems are also known. For example, U.S. Pat. No. 5,927,307 discloses an apparatus for environmentally acceptable cleaning of oil well components including removing paraffin and asphaltenes from the rods of the rod string of an oil well. U.S. Pat. No. 5,795,850 discloses an oil and gas well operation fluid used for the solvation of waxes and asphaltenes, and the method of use thereof. U.S. Pat. No. 5,827,952 discloses an acoustic-wave sensor apparatus and method for analyzing a fluid having constituents, which form deposits on the sensor when the sensor is cooled below a deposition-point temperature.

Whether performing a specific mitigating, remedial or prophylactic treatment or measuring a particular property of the formation fluid, these disclosed methods are typically indirect and involve one or more steps handled by an operator manually. Some of these methods are not very sensitive or require time-consuming measurements or analysis in a laboratory. Alternatively, where automated analytical methods are disclosed, such as in U.S. Pat. No. 6,087,662, the methods require prohibitively expensive apparatus and are complex and difficult to apply to a field application. Consequently, it is difficult and sometimes not feasible to automate the process of monitoring and controlling asphaltenes at a wellsite or in a pipeline system.

Another problem with trying to control asphaltene precipitation with conventional methods is that the cycle time is normally quite long between the times the samples are collected, the measurements are performed and, if needed, any adjustments of a particular treatment are made. As a result of this long cycle time, it is possible and even likely that either too much additive is added for unnecessary and expensive over-treatment, or too little is added for under-treatment, resulting in either wasted chemicals or excessive undesirable asphaltene precipitations or separations from the formation fluid. The same problem exists when the temperature of the formation fluid is used to control asphaltene precipitations and separations. Either under heating or overheating of a piece of equipment that may take place at an oil well or a pipeline system, resulting in inadequate heating or unnecessary waste of energy.

The present invention provides a system that uses one or more sensors to measure, directly and in real time at the wellsite or in a pipeline, a relative concentration of asphaltenes in a formation fluid or crude oil. The present invention also provides a system that measures the difference in relative asphaltene concentration in the formation fluid retrieved at the wellhead and that entering the wellbore from the formation. If the difference is larger than a predetermined range, a signal is transmitted from a controller or control unit to an apparatus to adjust the treatment relating to suppressing, controlling, inhibiting or otherwise mitigating asphaltene precipitations. It is also envisioned that the present invention may be used for monitoring asphaltenes in pipelines transporting oil from one location to another and controlling the necessary treatments.

SUMMARY OF THE INVENTION

In one aspect, the present invention is a system for determining the relative concentration of asphaltenes in a formation fluid from direct on-site measurements made on the formation fluid recovered from a subsurface formation, comprising: a fluid flow path for flowing formation fluid recovered from a subsurface formation; a sensor associated with the formation fluid in the fluid flow path providing data corresponding to the relative concentration of asphaltenes in the formation fluid in the fluid flow path; and a processor for determining from the data the relative concentration of asphaltenes in the formation fluid.

In another aspect, the present invention is a method for monitoring the relative concentration of asphaltenes in a formation fluid comprising the steps of: determining a relative concentration of asphaltenes in a formation fluid passing through a fluid flow path for recovering the formation fluid from a subsurface formation; making a subsequent determination of the relative concentration of asphaltenes in the formation fluid; and comparing the relative concentrations of asphaltenes in the formation fluid; wherein the determinations of the relative concentration of asphaltenes in the formation fluid is done on site, using a processor, in real time or near real time.

In still another aspect, the present invention is a method for monitoring and controlling the precipitation of asphaltenes out of a formation fluid comprising the steps of determining a relative concentration of asphaltenes in a formation fluid passing through a fluid flow path for recovering the formation fluid from a subsurface formation; making a subsequent determination of the relative concentration of asphaltenes in the formation fluid; and comparing the relative concentrations of asphaltenes in the formation fluid; wherein the determinations of the relative concentration of asphaltenes in the formation fluid is done on site, using a processor, in real time or near real time and additionally comprising pumping additives into the formation fluid when the difference in the relative concentrations of asphaltenes in the formation fluid is outside of a predetermined range.

BRIEF DESCRIPTION OF THE DRAWINGS

For a detailed understanding and better appreciation of the present invention, reference should be made to the following detailed description of the invention and the preferred embodiments, taken in conjunction with the accompanying drawings.

DETAILED DESCRIPTION OF THE PREFERRED EMBODIMENT

Figure 1:
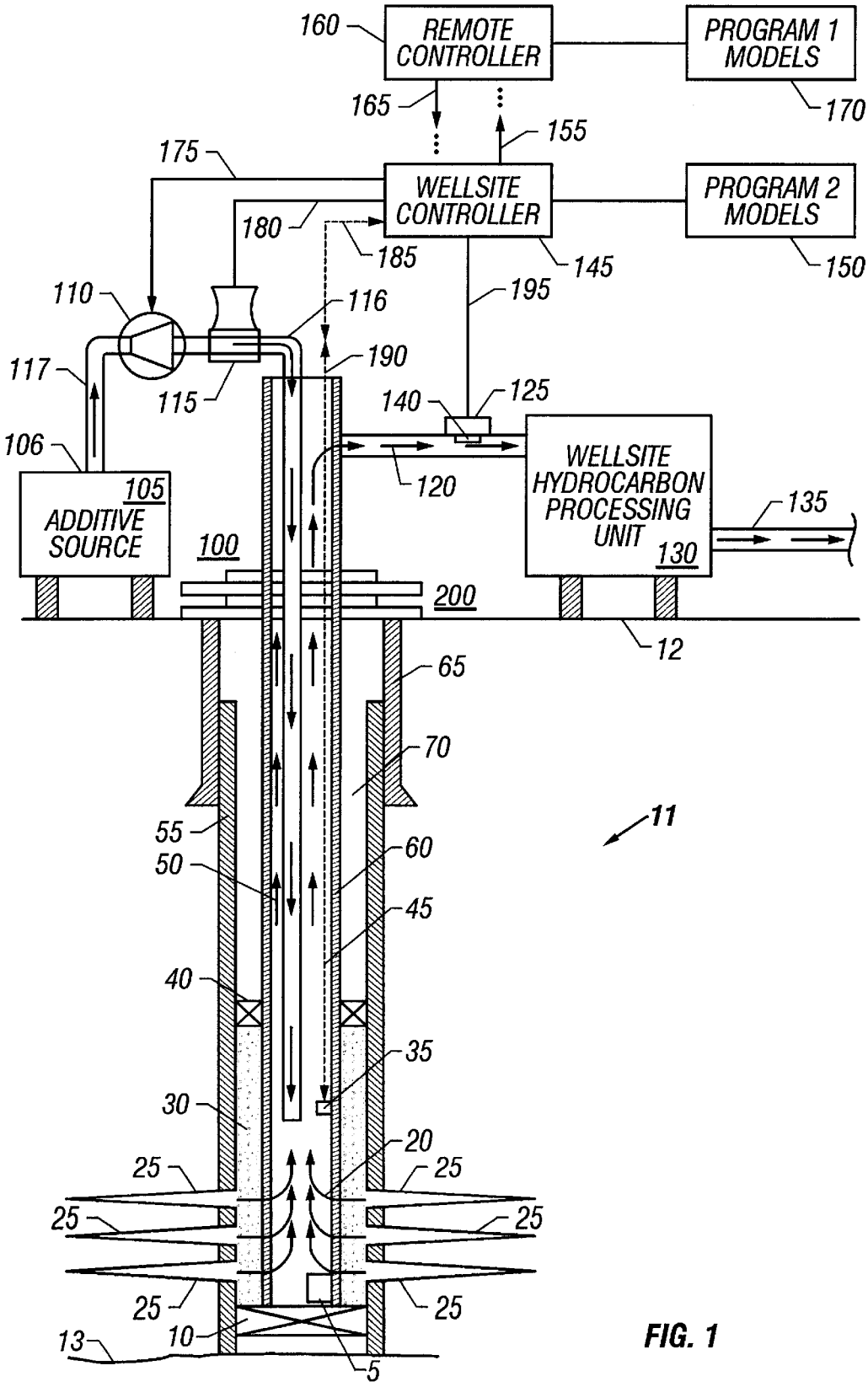
FIG. 1 is a schematic illustration of a wellsite system for monitoring the amount of asphaltenes reaching the wellhead and injecting chemicals in response to the monitored amounts according to one embodiment of the present invention.

The present invention relates to a system and method for monitoring and controlling asphaltenes. The system may be used at a wellsite, a pipeline, and other places where formation fluid, oil or other complex mixtures containing asphaltenes are produced, transported, stored or used.

A first direct measurement of a first asphaltenes relative concentration is made. This first measurement is compared with a second direct measurement which is second in time and/or in physical space relative to the first measurement, to analyze and to determine if there is a difference between the two measurements. If there is no difference or if the difference is within a predetermined range, a signal is sent to the controller or controllers, which controls the treatments dealing with asphaltenes, to maintain the current or existing treatment.

If the difference in measurements is outside the predetermined range, it indicates that an undesirable amount of asphaltenes has precipitated and become held up somewhere in the wellbore, pipeline, transportation or storage facility as the case may be. Asphaltenes are known to stick to different surfaces after they precipitate out of the well stream, oil flow or in a storage facility. In this case, a signal is sent by the controller or controllers to adjust the settings or rates in order to control, prevent, inhibit or otherwise mitigate the asphaltenes. The adjustments are made according to the nature and quantity of the difference. In most cases, additional chemicals, additives and solvents or higher temperatures are required to reduce or eliminate further precipitation of asphaltenes out of the formation fluid.

Another way of determining whether to make changes or adjustments of a treatment, such as a chemical injection, is to compare the concentration of asphaltenes in the flow path with a reference concentration. Preferably, the reference is a measurement of the asphaltenes in a sample of the reservoir fluids or crude oil being produced or transported wherein the asphaltenes concentration is at an acceptable level. If the relative concentration of asphaltenes in the flow path is significantly less than the reference concentration, it is an indication that asphaltenes have precipitated out, thus requiring changes of treatment.

Many different chemical, physical and spectroscopic ways of detecting and measuring the concentrations of asphaltenes in a complex mixture such as oil are utilized in the laboratory. Real-time or substantially real-time, on-site, asphaltene measurements are preferred and are thus provided in the present invention. For purposes of the present invention, on-site means in close proximity to the asphaltene containing formation fluid being monitored by the present invention. While any method known to those of ordinary skill in the art of making such measurements can be used with the present invention, it is preferred to use a fiber optic attenuated total reflection probe and an ultraviolet/visible spectrometer to directly measure the amounts of asphaltenes in a well stream, formation fluid or crude oil by measuring the absorbances in a wavelength range of about 200 nm to about 2,000 nm and then transmit the results to a data gathering and processing circuit or unit such as a microprocessor based unit or a computer for data analysis. For the purposes of the present invention, the term ATR means an attenuated total reflectance device including a probe and a means of measuring the absorbance of a material in contact with the probe.

An ATR is preferred for the practice of the present invention because it permits both in-laboratory measurements and real-time direct measurements of the absorbance of highly opaque or colored fluid or liquid within a process. Formation fluids, such as crude oil, containing asphaltenes are normally opaque and dark. ATR probes useful with the present invention can be placed at different locations in the flow paths of the formation fluid to collect the asphaltene-concentration data, whether in a wellbore, in a pipeline or in other transfer lines.

The readings of the absorbance spectra of a typical formation fluid, such as a well stream, are made at a wavelength ranging from about 200 nm to about 2,000 nm, generally known as the ultraviolet or UV, visible or VIS, and near infrared or NIR spectral regions. For the present invention, a preferred wavelength range is from about 220 nm to about 1,000 nm. More preferably, the wavelength range is from about 220 nm to about 800 nm, and most preferably from about 240 nm to about 400 nm.

In the practice of the present invention, a sample is analyzed with an ATR wherein a beam of light, a form of electromagnetic wave, from a source lamp of is sent to a sensor with an exposed surface placed in contact with the formation fluid in a chamber and the transmitted light is sent back to a filter/detector. With proper connections and the associated instruments and electronics, the signals of a measured absorbance may be transmitted conveniently by using optical fibers to a control unit for spectral data storage, analysis and/or comparisons. The absorbance spectrum obtained by using an ATR is analyzed and compared with the help of suitable computer programs or other processing unit. The path length may vary, depending on the wavelength of the light used. A correlation or calibration curve may be established, ex situ, to determine the amounts of asphaltenes in the formation fluid as a function of the absorbance. Periodic in situ or ex situ calibrations may be made to determine the accuracy of the measurements as well as the correlations. In addition, the asphaltene measurements may be made with references to air, toluene, xylenes or other suitable materials.

It is important that the ATR probe be selected such that it can be used in the application of the present invention. For example, in a wellbore, a probe can be exposed to corrosive conditions and high temperatures and/or pressures. The optics of the probe should be such that they will not decompose or become occluded. For example, preferably, the optics of a probe useful with the present invention will be made of sapphire.

The absorbance of asphaltenes in a formation fluid may be expressed in different ways. It can be determined at a single point data at a selected wavelength, at a plurality of wavelengths within the range disclosed herein, as an entire spectrum between two wavelengths or a combination thereof.

For a system of the present invention, it is preferred that there are at least two probes for obtaining at least two direct ATR measurement signals. For example, in the case of a system of the present invention being used to monitor an oil well, at least one probe is placed in the flow of fluid recovered at the wellsite in a fluid flow path prior to collecting the formation fluid for processing or transportation. There is typically an on-site processor to handle the data. The data obtained from direct ATR measurements of asphaltene contents in the formation fluid entering the perforations of the wellbore, exiting the wellhead and in a fluid flow path are collected, analyzed and compared. The probe data is processed at the wellsite to determine the asphaltene concentration in the fluid, which is compared to the expected amount.

The comparison of relative asphaltene concentrations can be accomplished by using a processor. The expected amount may be determined from analysis of prior fluid samples and/or modeling. If the amount of asphaltenes in the formation fluid retrieved at the wellhead is less than the expected amount, it can be reasonably inferred that (a) some asphaltenes have precipitated and separated out of the formation fluid between the perforations where the formation fluid enters the wellbore and the wellhead; and (b) the asphaltenes have stuck to some surface or become accumulated at certain places in the wellbore or other locations of the well. Depending on how much of the asphaltenes have precipitated, there may be a need to change or adjust various mitigating, controlling or inhibiting treatments such as injections of additives or changing temperatures. While any precipitation is not desirable, there may be a range within which precipitation can be tolerated. Instead of analyzing fluid samples and/or modeling to determine the expected asphaltene concentration in a formation fluid, a second ATR probe may be placed near the producing zone in the wellbore to provide a direct measure of the asphaltenes entering the wellbore. The comparison of the downhole and surface measurements will provide an accurate measure of the amount of asphaltenes precipitating out of solution in the wellbore and the corrective action required to alleviate such precipitation. The same surface equipment may be utilized for processing data from the downhole ATR probe.

For a system monitoring a pipeline transporting crude oil, it is preferred that there are also at least two ATR probes. It is preferred that at least one first probe is placed at a location to measure a first asphaltene content upstream in the pipeline transportation system. It is also preferred that there is at least one second probe downstream from the first probe to measure a second asphaltenes content. It is within the scope of the present invention that a plurality of probes are used to monitor a long pipeline and/or its associated equipment in order to determine (a) if the asphaltenes have precipitated; (b) where the asphaltenes have precipitated; (c) whether a treatment is needed or needs to be changed; and (d) what is a proper level of treatment.

As discussed hereinabove, there may be a plurality of probes for monitoring the asphaltenes concentrations in the same well or pipeline. It is also within the embodiment of the present invention to have a plurality of probes monitoring several wells or pipelines at the same time. The measured absorbance and the corresponding signals may be sent to the same or a different data processing unit, which compares the signals to determine if there exists a difference in asphaltenes contents between that of the formation fluid entering the wellbore or pipeline and that at other places in the well or pipeline.

If there is no difference or the difference is small and within a predetermined range, commands are sent to one or more controllers maintaining the current treatment without any changes. If the difference is larger than the predetermined range, commands are sent to the controller or controllers to adjust their output or outputs for changing current treatments in accordance with the difference. Examples of treatments include injections of additives, injection of solvents, which also can be considered as chemicals or additives as well for the present invention, adjustment of the temperatures of pipes, valves and various other equipment, or combinations thereof.

There are other references that can be used to determine the difference in asphaltene concentrations. One such reference is a calculated figure. This figure may be obtained by methods such as a theoretical calculation, by extrapolation or interpolation of a calibration curve, and others. Another, and preferred reference is a laboratory analysis of the asphaltenes in the actual fluid to be monitored. If it is difficult or not economic to place a probe downhole in the well, an intermittent sampling and analysis of the formation fluid in the wellbore is an acceptable reference of the present invention. It is also within the embodiment of the present invention to use a previous analysis from the same or a different monitoring system as a reference to determine the difference of asphaltenes concentrations.

In the practice of the present inventions, a predetermined range for a change in the relative asphaltene concentration of a fluid is used to trigger or not trigger actions to control asphaltene precipitation from a formation fluid. This predetermined rage can be prescribed in many different ways or even a combination of ways because it depends upon the point at which asphaltenes will precipitate from a formation fluid which itself is subject to a number of factors. The factors which affect asphaltene precipitation include the composition of the formation fluid, the asphaltene concentration in the particular formation fluid, the fluctuations of the asphaltene content in the formation fluid, the equipment, the well history, the accuracy of the ATR used, the operating experience of a particular well or pipeline or storage facility, the effectiveness of a particular treatment for a well or a pipeline or a storage facility, and many other factors.

One example of a way in which a predetermined range can be set is from an operating experience that certain asphaltene levels found in the formation fluid measured at the wellhead is acceptable, even though it is different from the level detected in the wellbore. It is also possible to set the predetermined range by setting a relative percentage of change. For the present invention, a suitable pre-determined range, on a relative basis, is a difference in asphaltene relative concentration within about 15%. For instance, if the reference asphaltene concentration is 4 wt %, a measured asphaltene concentration of 3.2 wt % in the wellhead formation fluid would trigger a change of the treatment, because it represents a 20% relative change. Alternatively, a change of ±0.5 wt % may be used as a predetermined range. In the above 4 wt % example, an asphaltene concentration between 3.5 wt % and 4.5 wt % measured in the wellhead formation fluid will not trigger a command to change the current treatment for controlling asphaltenes. It is also within the embodiment of the present invention not to use a fixed range. In other words, the range may have to be changed to reflect addition experience gained during the operation or changes in treatment methods, changing production process, etc.

Because all the steps and measurements of the present invention do not need operator intervention, except for checking the accuracy of the sensors or probes, the present invention can be automated with proper computing devices, such as computers, signal transmitters and receivers, computational programs or software to perform the necessary calculations and data comparisons, and other necessary mechanical devices, which can be controlled non-manually when receiving various electromagnetic, electrical, electronic or mechanical commands, instructions or signals.

While the sensors or probes are used to provide direct real-time measurements of asphaltenes, it is not required or needed that the measurements are made continuously. For the present invention, the sensors or probes may be operated in many different modes, continuous, semi-continuous, intermittent, batch or a combination thereof. Formation fluid composition and changes in the composition, operating experience and maintenance requirement are some of the factors that influence the choice of how often the measurements are made. Furthermore, it is also within the scope of the present invention that a different signal may be transmitted to a machine or computer or some other form of data processing unit, i.e., a processor, at a remote location and, in response to the difference observed, a decision of adjusting the output of an apparatus for a particular treatment is sent to that apparatus directly or back to the controller, which then sends a proper command to the apparatus.

A step-by-step description of one embodiment in accordance with the present invention is made with reference to FIG. 1. FIG. 1 is a schematic diagram of a system 100 wherein the asphaltenes are monitored with one or two sensors, one located at the surface wellhead and the other in the wellbore adjacent the point of entry of the formation fluid into the wellbore. The asphaltenes are controlled by a treatment using additive or solvent injections.

The system 100, in one aspect, is shown to include a well 11 with an upper casing 65 that extends a short distance below the surface 12 and a liner 55 that extends in the well depth 13, includes a number of downhole sensors 5 for monitoring the performance of the well 11 and other properties of the formation fluid 20 from the producing formation 15, which flows through multiple perforations 25, passing through screens 30 into a production tubing 60. A lower packer 10 and an upper packer 40 inside annulus 70 below and above the perforations 25 isolate the production zone 15. The screens 30 help filter out loose particles and other solids in the formation fluid 20. The wellbore fluid 50 flows upward inside the production tubing 60. An ATR Sensor 35 is disposed in the wellbore adjacent perforations 25 to provide a direct measurement of the amount of asphaltene in the formation fluids entering the wellbore 11. Sensor 35 is connected to downhole data/power communication link 45, which sends a signal 190 to a wellsite controller 145. Suitable ATR light 185 in the UV, VIS and/or NIR regions is supplied to the ATR sensor 35 from wellsite controller 145 via link 45.

Once the well fluid 120 reaches the surface 12, it passes through exposed surface 140 of an ATR asphaltenes measurement sensor 125 prior to entering into a wellsite hydrocarbon processing unit 130. The output of hydrocarbon processing unit 130 is discharged into pipeline 135 or to other suitable transportation systems The signals from the ATR sensor 125 are sent to the wellsite controller (processor) 145, which interacts with various programs and models 150. The wellsite controller 145 determines the amount or concentration of the asphaltenes present in the well stream 120 based on programs provided thereto. The controller 145 compares the directly measured amounts with the expected amount. If a downhole sensor, such as sensor 35 is utilized, then the controller 145 utilizing the programs 150, correlates signals 190 from sensor 35 with signal 195 from 140 to the corresponding asphaltene concentrations in well fluid 120 at the wellhead and well fluid 50 near perforations 25 in the wellbore. Based on these comparisons or correlations, programs and models 150 also determine if (a) they are different; (b) if the difference exceeds a predetermined range; and (c) how a treatment adjustment, if any, is needed in response to the difference.

If there is no difference or the difference does not exceed the predetermined range, then the controller 145 does not make any adjustment or changes to the pump speed 110 providing additives 105 from a source 106. If the difference exceeds the range, the controller 145 changes the pump 110 speed to adjust the amount of the chemical 105 to the desired amounts by increasing or decreasing the amount of additives from additive source 105 to suppress, control or mitigate the excessive asphaltene precipitation and separation. The chemicals 105 are discharged into the well 116 via a line to a suitable depth, usually adjacent the perforations.

A precision meter 115, such as a nutating or positive displacement meter, in the additive supply line 117 provides to the controller 145 measurements for the amount of additive 105 being supplied to the well 11. Optionally, information from wellsite controller 145 may be sent to remote controller (processor) 160, which interacts with various programs and models 170. Just like 150, programs and models 170 correlate signals 190 from sensor 35 with signal 195 from 140 to the corresponding asphaltene concentrations in well fluid 120 at the wellhead and well fluid 50 near perforations 25 in the wellbore. Based on these correlations, programs and models 170 also determine if (a) they are different; (b) if the difference exceeds a predetermined range (value); and (c) how a treatment adjustment, if any, is needed in response to the difference. Appropriate instructions 165, in response to the measurements, is sent to the wellsite controller 145, which relays these instructions to pump 110 and/or meter 115.

All of the signals and/or instructions from computers or controllers may be communicated via conventional methods such as proper cables, optical fibers, etc. Alternatively, wireless communications are also within the embodiment of this invention. All of the measurements, comparisons and other operations may be automated with the help of proper devices. The system 100 may be a totally automated system. It is also possible to have manual intervention by an operator at the wellsite and/or at the remote location. Moreover, where a remote-controller (processor) 160 is used, the programs 170 and 150, which reside in the same or different computing systems, can be used as a reciprocal backup operation.

As previously discussed, it is optional to have a plurality of chemical sources and the respective pumps and metering devices to administer different additives or chemicals or solvents. These can be controlled individually or in concert with one another by one or more controllers such as 145 and 160. It is also within the scope of the present invention to use the same or different wellsite (on-site) and/or remote controllers processors 145 and 160 to control the operation of two or more wells at the same time.

It is further noted that while a part of the foregoing disclosure is directed to some preferred embodiments of the invention or embodiments depicted in the accompanying drawings, various modifications will be apparent to and appreciated by those skilled in the art. It is intended that all such variations within the scope and spirit of the claims be embraced by the foregoing disclosure.

EXAMPLES

The following examples are provided to illustrate the present invention. The examples are not intended to limit the scope of the present invention and they should not be so interpreted. Amounts are in weight parts or weight percentages unless otherwise indicated.

Example 1

Figure 2:
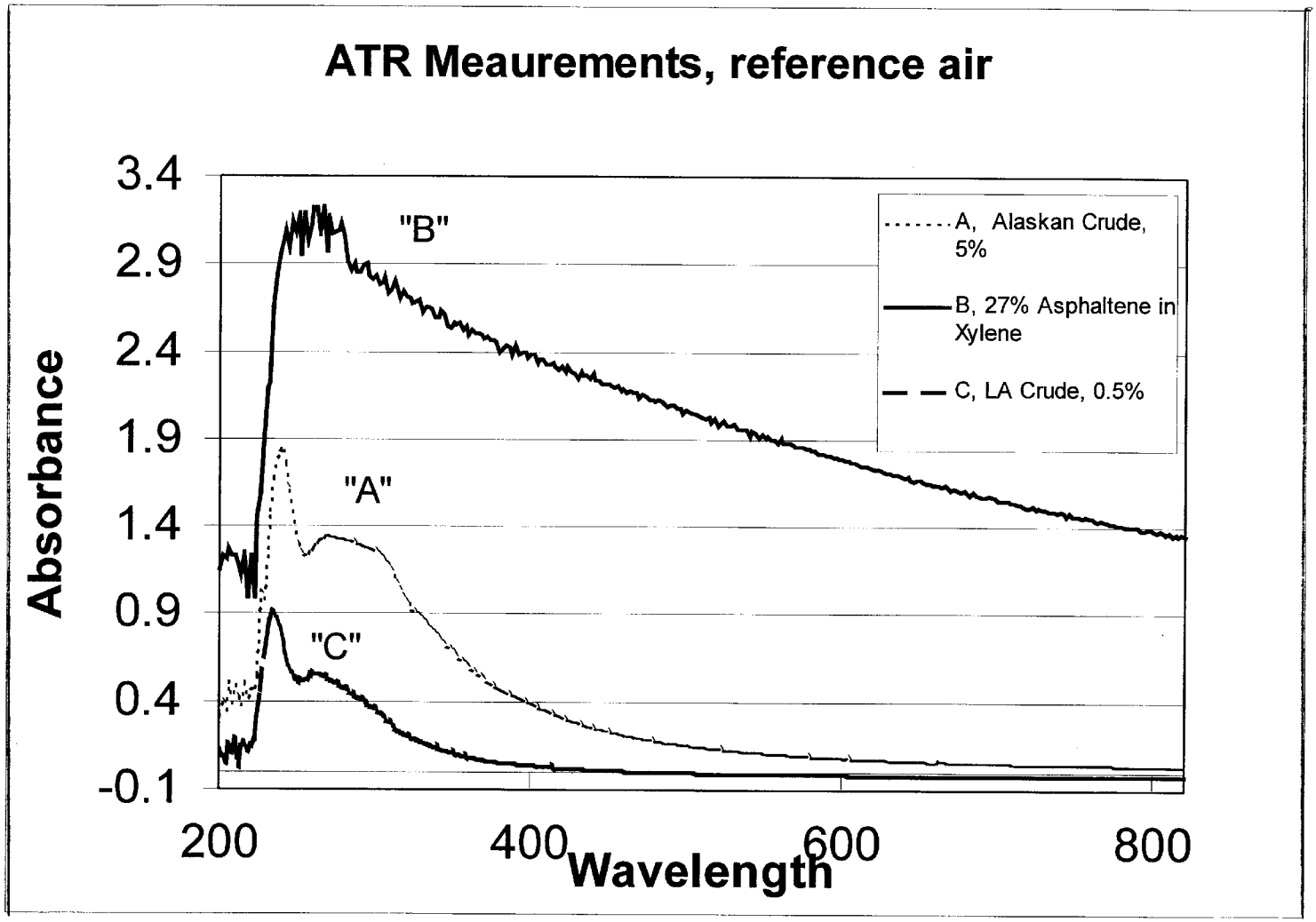
FIG. 2 shows a representative absorbance spectrum corresponding to different amounts of asphaltenes in xylenes.

Laboratory measurements utilizing a UV/visible Spectrophotometer and a fiber-optic ATR probe with air as a reference are used to determine the absorbance as a function of wavelength for different concentrations of asphaltene in crude oil. Spectrum A is obtained with an Alaskan crude with 5 wt % asphaltenes; spectrum B, a synthetic mixture of 2.7 wt % of asphaltenes in xylenes; and spectrum C, a Louisiana crude having about 0.5 wt % asphaltenes. The spectra A–C, FIG. 2, show that there is a monotonic correlation between the asphaltenes concentrations and ATR absorbances in a wavelength range of from about 220 nm to about 400 nm.

Example 2

Figure 3:
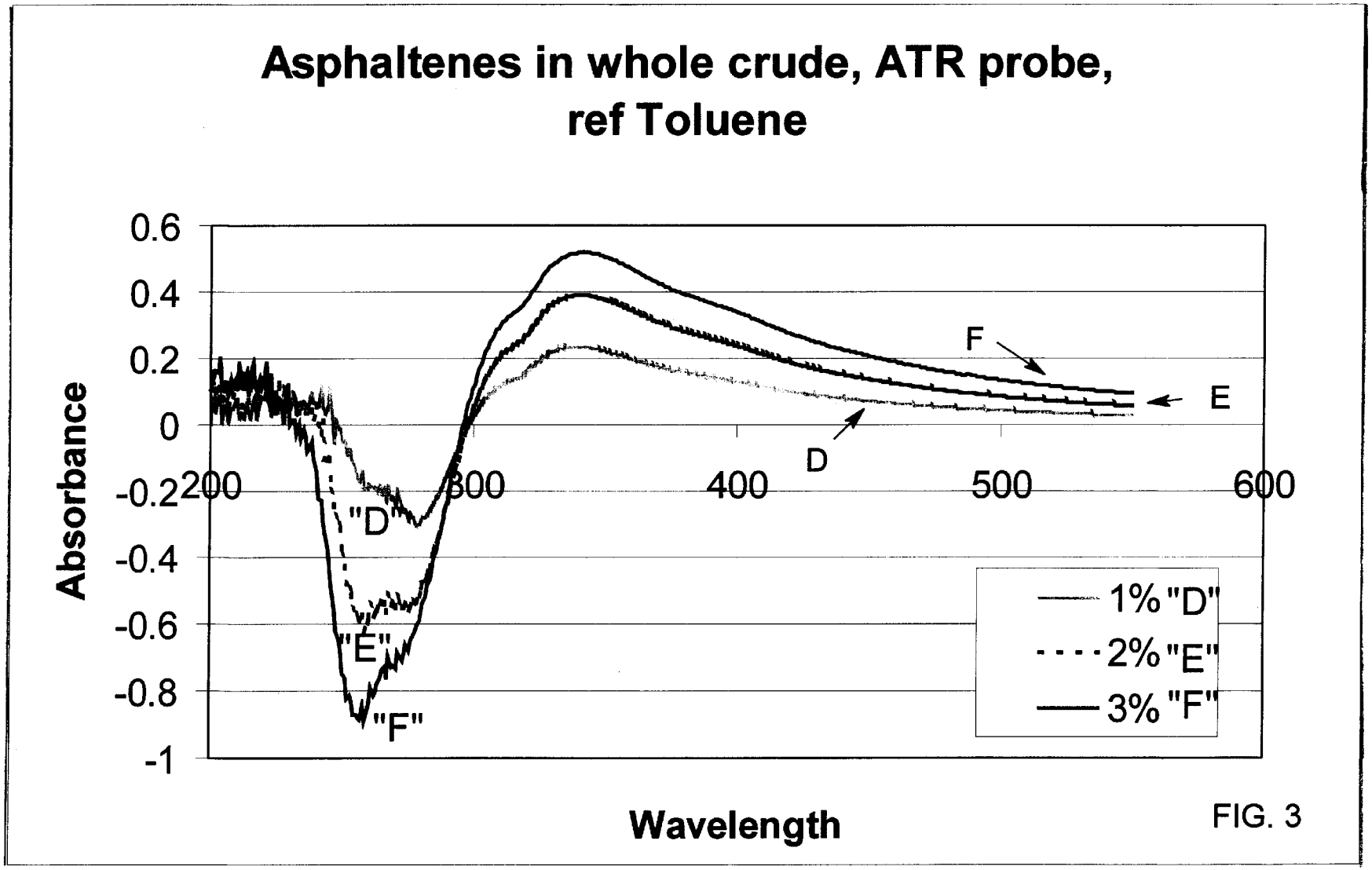
FIG. 3 shows a representative absorbance spectrum of different amount of asphaltenes in toluene.

Example 2 is carried out in a similar manner as Example 1, except that the various samples are measured with toluene as a reference. ATR spectra D, E, and F are obtained with 3 wt %, 2 wt % and 1 wt % of asphaltenes in crude oil respectively. The results are shown in FIG. 3. The spectra in FIG. 3 also show that there is a monotonic correlation between the asphaltenes concentrations and ATR absorbances in a wavelength range of from about 220 nm to about 550 nm. These experiments described above in FIGS. 2 and 3 indicate the suitability of an ATR probe for directly measuring asphaltene concentration in oil containing formation fluids.

Example 3

Figure 4:
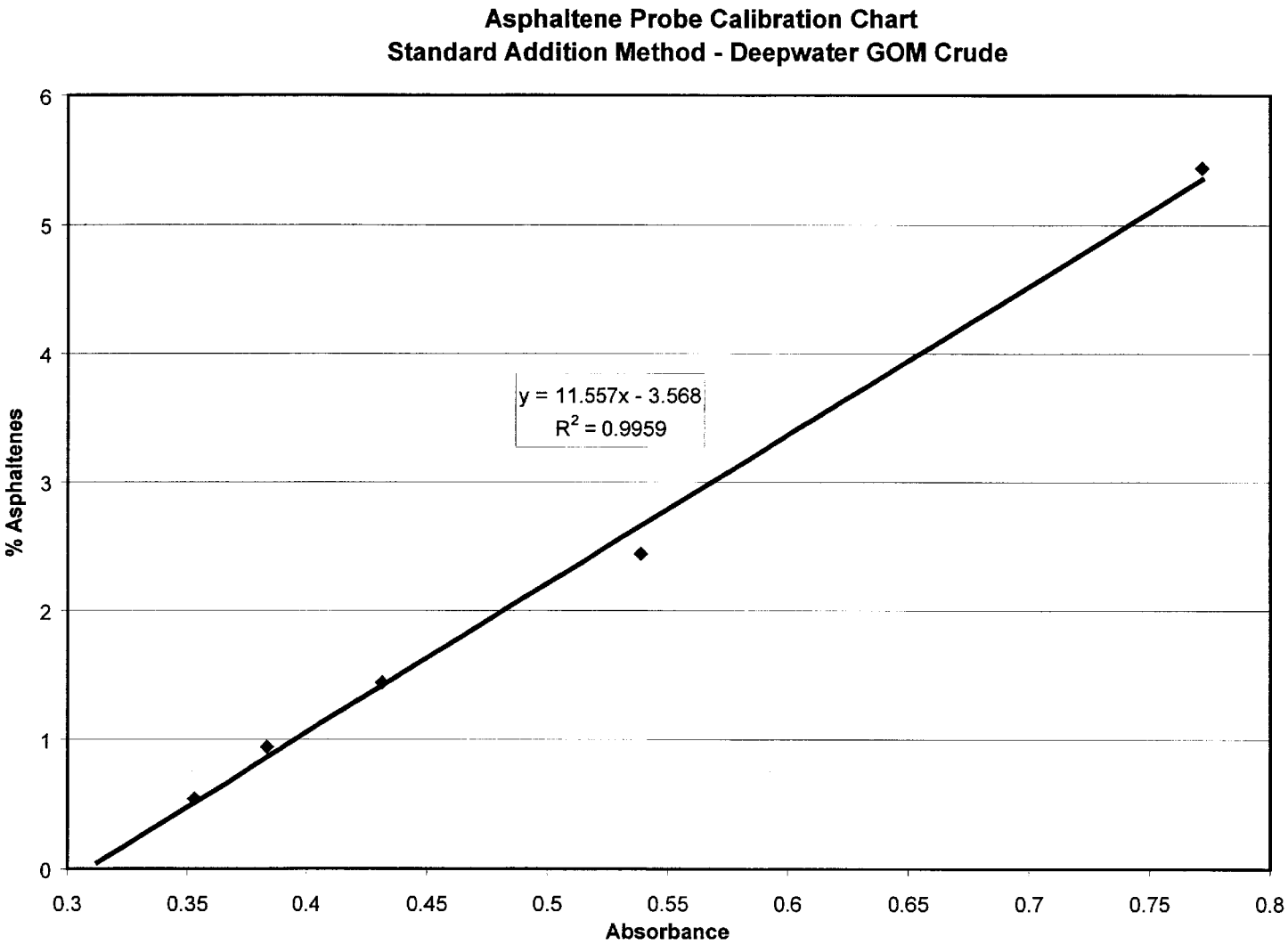
FIG. 4 represents a typical correlation of the absorbance measured with asphaltenes contents by weight.

Asphaltenes are extracted from a crude sample by precipitation with heptane. The extracted asphaltenes are added to a crude oil sample and the absorbance measured with the probe at 233 nm. The crude originally contained 0.44% asphaltenes. The resulting plot of % asphaltenes vs. absorbance yields a linear correlation with an $R^2$=0.9959. The results are displayed below in Table 1 and in graphical form in FIG. 4.

TABLE 1

| Absorbance @ 233 nm | Total % Asphaltenes of Sample |
|---|---|
| 0.3529 | 0.54 |
| 0.3833 | 0.94 |
| 0.4312 | 1.44 |
| 0.5389 | 2.44 |
| 0.7719 | 5.44 |

Example 4

Figure 5:
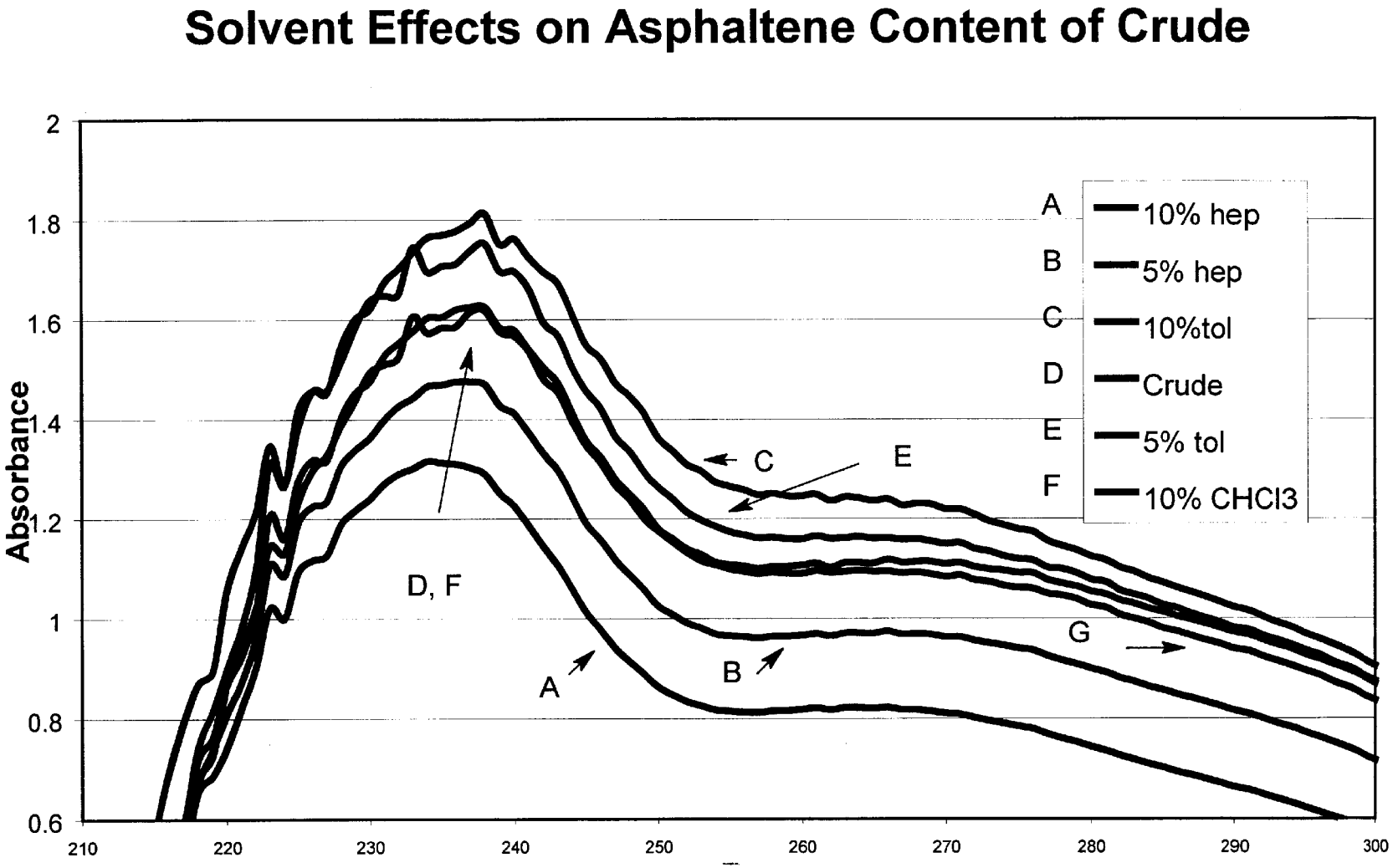
FIG. 5 represents the effects of certain solvents on the relative asphaltene concentration of a crude oil sample and the resultant changes in the sample's UV absorbance spectra.

Three solvents; chloroform, toluene, and heptane; are selected to be added to a sample of crude oil. Chloroform has no effect on asphaltenes in crude oil. Toluene dissolves asphaltenes. Heptane precipitates asphaltenes from crude oil. The UV absorbance of the crude oil sample is measured, 5 and 10 percent chloroform are added to the sample and the absorbance measured again with very little change in absorbance. 5 and 10 percent toluene are added to a sample of the same crude oil. Absorbance measurements increase, indi cating an increase in dissolved asphaltene content. 5 and 10 percent heptane are added to a sample of the same crude oil. The absorbance decreases, indicating a decrease in the amount of dissolved asphaltene content of the sample. The results are displayed below in Table 2 and graphically in FIG. 5.

TABLE 2

| Sample | Probe Reading (Absorbance @ 233 nm) | Probe Reading (Absorbance @ 254 nm) |
|---|---|---|
| Crude + 10% toluene | 1.769 | 1.274 |
| Crude + 5% toluene | 1.707 | 1.185 |
| Crude (neat) | 1.605 | 1.113 |
| Crude + 5% chloroform | 1.612 | 1.154 |
| Crude + 10% chloroform | 1.584 | 1.107 |
| Crude + 5% heptane | 1.469 | 0.9687 |
| Crude + 10% heptane | 1.312 | 0.8170 |

What is claimed is:

1. A system for determining the relative concentration of asphaltenes in a formation fluid from direct on-site measurements made on the formation fluid recovered from a subsurface formation, comprising:

a fluid flow path for flowing formation fluid recovered from a subsurface formation;

a sensor associated with the formation fluid in the fluid flow path providing data corresponding to the relative concentration of asphaltenes in the formation fluid in the fluid flow path;

a processor for determining from the data the relative concentration of asphaltenes in the formation fluid, and a chemical injection unit for injecting at least one chemical into the formation fluid prior to flowing the formation fluid through the fluid flow path, wherein (a) the processor makes real time relative concentration determinations of asphaltenes in the formation fluid; and (b) the sensor is a fiber optic attenuated total reflectance probe which has an exposed surface in contact with the formation fluid in the fluid flow path.

2. The system of claim 1 wherein the fluid flow path is a wellbore.

3. The system of claim 1 wherein the fluid flow path is an oil pipeline.

4. The system of claim 1 wherein the processor determines absorbance from the sensor data as a function of wavelength.

5. The system of claim 1 wherein the processor causes the chemical injection unit to change the amount of the chemical injected if the concentration of asphaltenes is determined to be outside a predetermined range.

6. The system of claim 5 wherein the chemical injection unit comprises:

a source of the chemical;

a pump for pumping chemical into the formation fluid; and a meter for measuring the amount of the chemical injection into the formation fluid.

7. The system of claim 6 further comprising a remote processor communicating with an on site processor, the remote processor providing instructions to the on site processor for the control of chemical injection unit.

8. The system of claim 1 wherein the sensor is a first sensor and further comprising a second sensor placed in the flow of the formation fluid at a location upstream of the first sensor.

9. The system of claim 8 wherein the first sensor is at the surface and the second sensor is located in the wellbore.

10. The system of claim 8 wherein the first and second sensors are located in a pipeline carrying the formation fluid.

11. A method for monitoring and controlling the precipitation of asphaltenes out of a formation fluid comprising the steps of determining a relative concentration of asphaltenes in a formation fluid passing through a fluid flow path for recovering the formation fluid from a subsurface formation; making a subsequent determination of the relative concentration of asphaltenes in the formation fluid; and comparing the relative concentrations of asphaltenes in the formation fluid against a known acceptable range of asphaltene concentration values;

wherein the determinations of the relative concentration of asphaltenes in the formation fluid is done on site, using a processor, in real time or near real time and additionally comprising pumping additives in the formation fluid when the difference in the relative concentrations of asphaltenes in the formation fluid is outside of a predetermine range.

12. The method of claim 11 wherein the relative concentration of asphaltenes in a formation fluid is determined by the processor using data from an a fiber optic attenuated total reflectance probe.

13. The method of claim 12 wherein the data from an a fiber optic attenuated total reflectance probe is UV absorbance data.

14. The method of claim 13 wherein the UV absorbance data is absorbance in the range of from about 220 nm to about 800 nm.

15. The method of claim 14 wherein the UV absorbance data is absorbance in the range of from about 220 nm to about 400 nm.

* * * * *